United States Patent [19]

Stegner

[11] 4,205,590

[45] Jun. 3, 1980

[54] POSITIVE FEEDBACK MECHANISM FOR SERVOCONTROLLER OF FLUID OPERATED ACTUATOR

[75] Inventor: James C. Stegner, Lancaster, N.Y.

[73] Assignee: Moog Inc., East Aurora, N.Y.

[21] Appl. No.: 875,389

[22] Filed: Feb. 6, 1978

[51] Int. Cl.[2] ..... F15B 13/16; F15B 9/10

[52] U.S. Cl. ..... 91/359; 91/365; 91/374; 91/388; 91/506

[58] Field of Search ..... 91/365, 374, 359, 388, 91/506

[56] References Cited

U.S. PATENT DOCUMENTS

| | | | |
|---|---|---|---|
| 1,109,022 | 9/1914 | Spicer | 91/388 |
| 2,603,065 | 7/1952 | Sorto | 91/374 |
| 2,789,543 | 4/1957 | Popowsky | 91/365 |
| 2,947,286 | 8/1960 | Boltus et al. | 91/365 |
| 2,995,116 | 8/1961 | Dobbins | 91/359 |
| 3,429,225 | 2/1969 | Keyworth | 91/506 |

FOREIGN PATENT DOCUMENTS

| | | | |
|---|---|---|---|
| 525878 | 6/1931 | Fed. Rep. of Germany | 91/374 |

*Primary Examiner*—Paul E. Maslousky
*Attorney, Agent, or Firm*—Sommer & Sommer

[57] ABSTRACT

The dynamic performance of hydraulic apparatus including a fluid-operated actuator controlled by a servocontroller, is improved by providing phase lead compensation to the controller in response to movement of the movable element of the actuator so that the low frequency response of the apparatus is raised.

10 Claims, 9 Drawing Figures

POSITIVE FEEDBACK MECHANISM FOR SERVOCONTROLLER OF FLUID OPERATED ACTUATOR

FIELD OF THE INVENTION

This invention relates to the field of servocontrollers for fluid-operated actuators in hydraulic apparatus, such as strokers for variable displacement hydraulic pumps and motors used in hydrostatic transmissions.

BACKGROUND

Variable displacement hydraulic pumps and motors are often used as a rugged, reliable and convenient way to transfer drive shaft power in a controlled manner. Such hydrostatic drives are used in construction vehicles and equipment, agricultural machinery, materials handling equipment, maritime vessels, machine tools, garden tractors and recreational vehicles.

In a typical application, a variable displacement pump is driven by a power source, such as a diesel or gasoline engine, turbine or electric motor. Flexible hydraulic lines or hoses connect the pump output to a hydraulic motor that drives the load.

In one known prior art form of hydrostatic drive, the pump was a variable-displacement piston pump having a pivotal swashplate for determining the length of stroke of a pump piston. The angle of this swashplate was set by stroker pistons controlled from an electrical command signal to an electrohydraulic servovalve which had an output stage comprising separately and relatively movable spool and sleeve valving members to control fluid flow with respect to such stroker pistons. The position of the stroker pistons determined the angularity of the swashplate and hence the displacement of the pump. A mechanical connection was made between the swashplate and the valve sleeve to provide one-to-one follow-up feedback with respect to the valve spool. In this manner, an electrical input to the electrohydraulic controller commanded a proportional displacement of the valve spool which caused a hydraulic output to the stroker pistons to create, ultimately, swashplate position and pump displacement proportional to the electrical input.

Such an arrangement having a mechanical feedback mechanism between the pump swashplate and the output stage of the servovalve is disclosed in the U.S. patent application of John T. Caruso, entitled "Feedback Mechanism For Variable Displacement Hydraulic Device Having An Electrohydraulic Controller", signed by him on Jan. 11, 1978, further identified by Ser. No. 869,829 filed Jan. 16, 1978, and owned by the assignee of the present application. The disclosure of said application Ser. No. 869,829 is incorporated herein by cross-reference thereto.

SUMMARY OF THE INVENTION

The present invention improves hydraulic apparatus in which an actuator having a movable element is hydraulically controlled by a servovalve having two or more stages of hydraulic amplification, by providing a positive inner feedback loop that compensates the dynamic lag associated with the actuator element to improve the dynamic performance of the apparatus. More specifically, the predominant low frequency lag created by the integration effect of the actuator element is canceled by a phase lead effect associated with the positive feedback loop, and in its place is a higher frequency, second order effect. The result is improved low frequency dynamic response for the apparatus.

The general object of the present invention therefore is to improve the low frequency dynamic response of hydraulic apparatus which includes a servovalve controlling the movable element of an actuator.

Another object is to provide simple means for achieving such improved dynamic response.

Other objects and advantages of the present invention will be apparent from the following detailed description of a preferred embodiment illustrated in the accompanying drawings.

DETAILED DESCRIPTION OF THE PREFERRED EMBODIMENT

Figure 1:
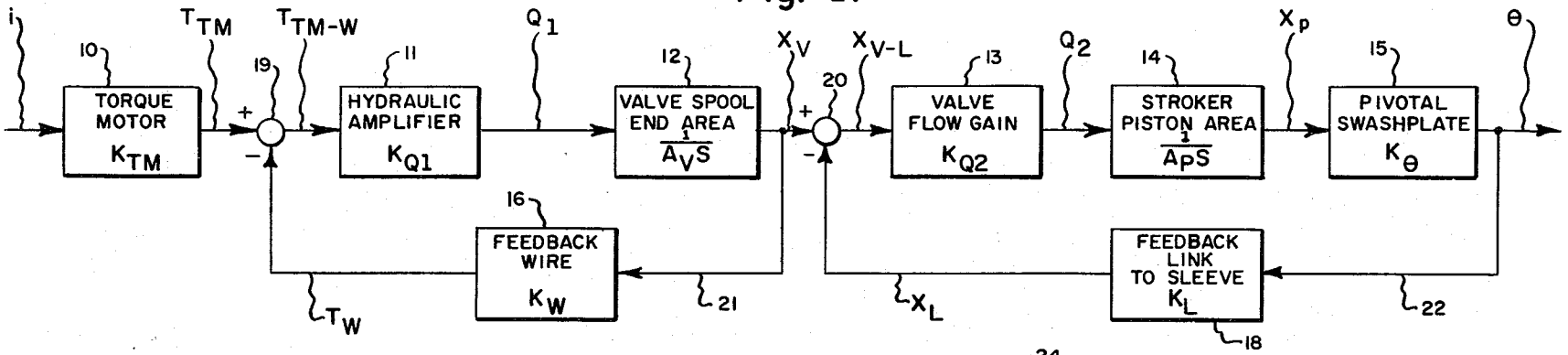
Fig. 1. (PRIOR ART)
FIG. 1 is a block diagram for a prior art servomechanism of the type disclosed in said application Ser. No. 869,829.

Prior Art (FIG. 1)

The present invention can best be understood by first considering the block diagram of FIG. 1 for the prior art servomechanism disclosed in said application Serial No. 869,829.

Referring to FIG. 1, the feedforward elements include a torque motor block 10 having a function $K_{TM}$, a hydraulic amplifier block 11 having a function $K_{Q1}$, a valve spool end area block 12 having a function $1/A_VS$, a valve flow gain block 13 having a function $K_{Q2}$, a stroker piston area block 14 having a function $1/A_PS$, and a pivotal swashplate block 15 having a function $K_\theta$. The feedback elements include a feedback wire block 16 having a function $K_W$, and a feedback to sleeve link block 18 having a function $K_L$.

Electrical current, represented by line i, is fed forward into block 10 which produces a torque, represented by line $T_{TM}$. This torque $T_{TM}$ is fed forward to a summing point or comparator 19. A net torque, represented by line $T_{TM-W}$ is fed forward to block 11 which produces a flow, represented by line $Q_1$. This flow $Q_1$ is fed forward to block 12 which produces a valve spool displacement, represented by line $X_V$. This displacement $X_V$ is fed forward to a summing point or comparator 20. A net displacement, represented by line $X_{V-L}$, is fed forward to block 13 which produces a flow, represented by line $Q_2$. This flow $Q_2$ is fed forward to block 14, which produces a stroker piston displacement, represented by line $X_p$. This displacement $X_p$ is fed forward to block 15 which produces a swashplate angular displacement, represented by line $\theta$.

Valve spool displacement $X_V$ is fed back, as represented by line 21, to block 16 which produces a torque, represented by line $T_W$. This torque $T_W$, as a negative feedback, is fed back to comparator 19 and summed with torque $T_{TM}$ to produce a net torque $T_{TM-W}$ which is effective on the armature/flapper.

Swashplate angular displacement $\theta$ is fed back, as represented by line 22, to block 18 which produces a displacement of the valve sleeve, represented by $X_L$. This displacement $X_L$, as a negative feedback, is fed to comparator 20 and summed with displacement $X_V$ to produce net displacement $X_{V-L}$ which is the valve spool displacement relative to the valve sleeve.

The following tabulation of symbols so far considered lists their respective descriptions and units:

| Symbol | Description | Unit |
|---|---|---|
| $A_P$ | stroker piston area | $in^2$ |
| $A_V$ | valve spool end area | $in^2$ |
| i | electrical current | ma |
| $K_L$ | swashplate mechanical feedback linkage ratio | $\frac{in}{deg}$ |
| $K_\theta$ | swashplate drive lever ratio | $\frac{deg}{in}$ |
| $K_{Q1}$ | hydraulic amplifier flow gain | $\frac{in^3/sec}{in\ lb}$ |
| $K_{Q2}$ | valve flow gain | $\frac{in^3/sec}{in}$ |
| $K_{TM}$ | torque motor gain | $\frac{in\ lb}{ma}$ |
| $K_W$ | servovalve feedback wire stiffness | $\frac{in\ lb}{in}$ |
| $Q_1$ | flow from hydraulic amplifier to spool end area | $\frac{in^3}{sec}$ |

-continued

| Symbol | Description | Unit |
|---|---|---|
| $Q_2$ | flow to stroker piston end area | $\frac{in^3}{sec}$ |
| S | LaPlace operator | $\frac{1}{sec}$ |
| $T_{TM}$ | torque from torque motor | in lb |
| $T_W$ | torque from feedback wire | in lb |
| $T_{TM-W}$ | net torque on armature/flapper | in lb |
| $X_L$ | displacement of valve sleeve | in |
| $\dot{X}_L$ | velocity of valve sleeve | $\frac{in}{sec}$ |
| $X_p$ | displacement of stroker piston | in |
| $X_V$ | displacement of valve spool | in |
| $X_{V-L}$ | displacement of valve spool relative to valve sleeve | in |
| $\theta$ | angular displacement of swashplate | deg |

Neglecting second order effects, such as torque motor dynamics, spool and piston mass, oil compliance, loading effects on the pump piston, and non-linearities, the output-to-input transfer function of the servocontroller is $$\frac{\theta}{i} = \left(\frac{K_{TM}}{K_W K_L}\right)\left(\frac{1}{1+t_1S}\right)\left(\frac{1}{1+t_2S}\right) \quad \frac{deg}{ma}$$

where $t_1 = \frac{A_V}{K_W K_{Q1}}$ sec $t_2 = \frac{A_P}{K_L K_\theta K_{Q2}}$ sec $t_1$ represents the valve lag in seconds, and $t_2$ represents the stroker lag in seconds. The quantity $(K_{TM}/K_W K_L)$ represents the sensitivity of the servocontroller expressed as degrees per milliampere (deg/ma); the quantity $(1/[1+t_1S])$ represents the valve dynamics expressed without unit; and the quantity $(1/[1+t_2S])$ represents the stroker dynamics expressed without unit.

Figure 3:
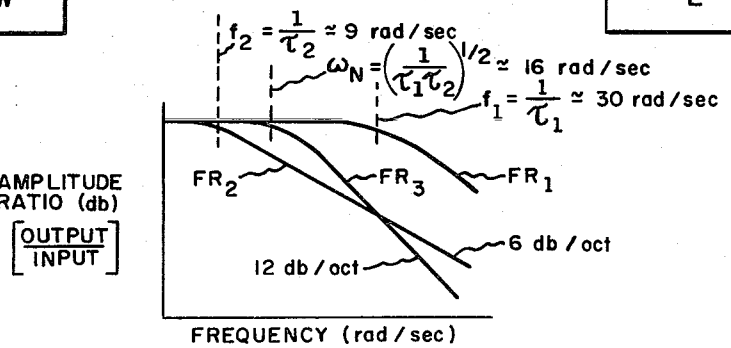
FIG. 3 is a graph depicting comparatively the frequency responses of the prior art and inventive servomechanisms.

The frequency responses of the valve dynamics and the stroker dynamics are depicted in FIG. 3, wherein the amplitude ratio of the output to input, in decibels (db), is plotted against frequency, in radians per second (rad/sec). The frequency response for the valve dynamics is identified as $FR_1$. The frequency response for the stroker dynamics is identified as $FR_2$. The corner frequency $f_1$ of curve $FR_1$ for the valve dynamics is equal to $1/t_1$, typically 30 radians per second (rad/sec). The corner frequency $f_2$ of curve $FR_2$ for the stroker dynamics is equal to $1/t_2$, typically 9 rad/sec. The slope of curve $FR_2$ well above corner frequency $f_2$ is typically 6 decibels per octave (db/oct), meaning that the amplitude ratio will fall 6 db everytime the frequency doubles. It will be recognized from FIG. 3 by those skilled in the art, that the stroker loop contributes more low frequency phase lag to the overall pump stroking servocontroller than the servovalve loop.

Figure 2:
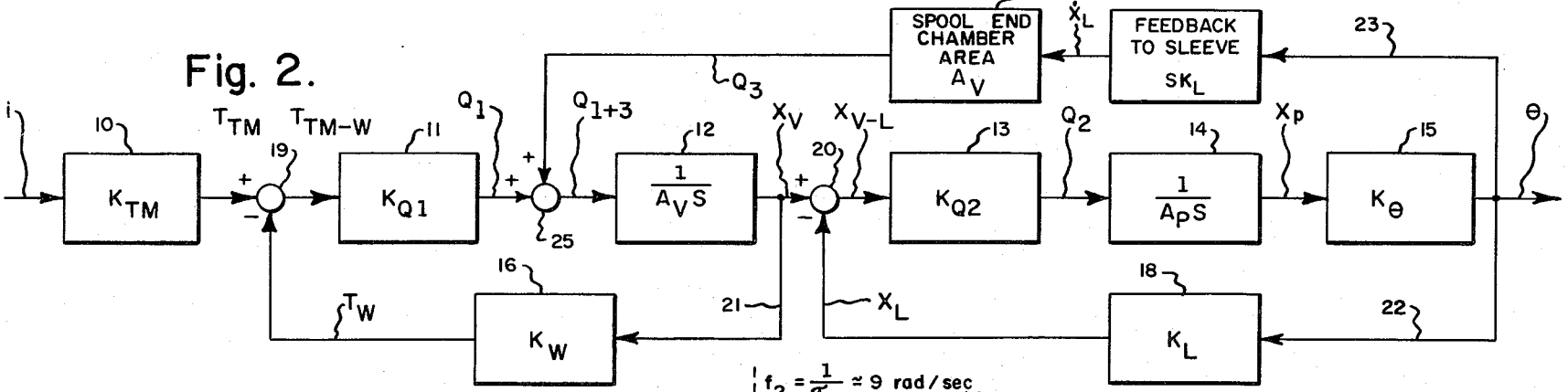
FIG. 2 is a block diagram for a servomechanism embodying the present invention, being similar to the diagram of FIG. 1 except for the addition of a positive inner feedback loop for phase lead compensation.

Principle of Inventive Concept (FIGS. 2-3)

In accordance with the present invention, the predominant low frequency phase lag associated with the stroker loop is compensated for by providing positive feedback that is related to stroker piston velocity. The result is improved low frequency dynamic response of the combined valve and stroker servocontroller. In FIG. 3, the improved frequency response of the inventive servomechanism is represented by the curve identified as $FR_3$.

If the valve spool end chambers are formed by the slidable valve sleeve which surrounds the valve spool, the block diagram of the improved servomechanism becomes that shown in FIG. 2, which is the same as that shown in FIG. 1 for the prior art except for an additional feedback loop between the angular displacement of the swashplate and the flow applied to the valve spool end area. Thus, referring to FIG. 2, angular displacement of the swashplate, $\theta$, causes movement of the valve sleeve through the feedback linkage ratio $K_L$. The velocity of this movement, $X_L$, is represented diagrammatically in FIG. 2 by $SK_L$. Movement of the valve sleeve changes the relative fluid volumes of the spool end chambers which is represented in FIG. 2 by an equivalent flow, $Q_3$, tending to displace the valve spool. This flow $Q_3$, as a positive feedback, is fed to a summing point or comparator 25, to which the output flow $Q_1$ from the hydraulic amplifier is fed as an input. Flows $Q_1$ and $Q_3$ are summed by comparator 25 to provide a combined flow, represented by line $Q_{1+3}$. This flow $Q_{1+3}$ is fed to block 12 where it is integrated by the valve spool end area.

The output/input transfer function of the block diagram for the servocontroller shown in FIG. 2 is $$\frac{\theta}{i} = \left(\frac{K_{TM}}{K_W K_L}\right)\left\{\frac{1+t_2S}{\left[\left(\frac{S}{\omega_N}\right)^2+\left(\frac{2\xi S}{\omega_N}\right)+1\right]}\right\}\left(\frac{1}{1+t_2S}\right)$$

$$= \left(\frac{K_{TM}}{K_W K_L}\right)\left[\frac{1}{\left(\frac{S}{\omega_N}\right)^2+\left(\frac{2\xi S}{\omega_N}\right)+1}\right]\frac{\text{deg}}{\text{ma}}$$

where $\omega_N = \left(\frac{K_{Q1}K_W}{A_V t_2}\right)^{\frac{1}{2}} \frac{\text{rad}}{\text{sec}}$ $$\frac{2\xi}{\omega_N} = t_2 \text{ sec}$$

in which $\omega_N$ is the natural frequency of the combined valve and stroker dynamics; and $\xi$ is the damping ratio associated with this natural frequency. It will be seen that the combined dynamics have the effect of canceling the predominant low frequency, first order lag, $(1/[1+t_2S])$, associated with the stroker loop. In its place is a higher frequency, second order effect. This results in improved dynamic response in the lower frequency region, represented by the curve $FR_3$ in FIG. 3. The corner frequency or natural frequency $\omega_N$ of curve $FR_3$ is equal to $(1/t_1t_2)^{1/2}$, typically 16 rad/sec as compared to 9 rad/sec, the typical corner frequency associated with curve $FR_2$.

Embodiment of Inventive Concept (FIGS. 4-9)

The salient structural feature which distinguishes the servomechanism of the present invention, shown in FIGS. 4-9, from the prior art servomechanism disclosed in said application Ser. No. 869,829, is in the manner of defining the outer walls of the spool end chambers in the output stage of the servovalve. In said prior art servomechanism, each such end chamber outer wall was a transverse wall fixed to the valve body and hence stationary with respect to the movable sleeve and spool valving members; whereas, in the inventive servomechanism, the end chamber outer wall is fixed to the sleeve member and hence movable with it.

Referring to FIGS. 4-9, a variable-displacement pump 30 is shown as controlled by an electrohydraulic servovalve 31.

Pump 30 is shown as having a stationary housing 32 surrounding a rotatable cylinder block 33 adapted to be rotated by a shaft 34 driven by any suitable prime mover or power source (not shown). Block 33 is shown as having a pair of pump pistons 35, 35 severally arranged on opposite sides of shaft 34, each having a rod 36 carrying a pivotal shoe 38 at its outer end. These shoes 38 bear against a swashplate 39 on opposite sides of its pivotal axis 40, which extends transversely of the longitudinal axis of shaft 34. Pump output flows through output passages 41, 41 which are suitably connected to a hydraulic actuator (not shown).

The representative means shown for setting the angular position of swashplate 39 about its axis 40, include a first control piston 42 in a first cylinder 43, and a second control piston 44 in a second cylinder 45, each such piston having a return spring 46. Cylinders 43 and 45 are served hydraulically by ports 47 and 48, respectively. A link 49 connects piston 42 to swashplate 39 above axis 40, and a similar link 50 connects piston 44 to the swashplate below such axis.

By controlling differentially the flow of hydraulic fluid through ports 47 and 48, pistons 42 and 44 can pivot swashplate 39 about its axis 40 and thereby control the length of stroke for pump pistons 35.

Servovalve 31 is shown as having a first-stage hydraulic amplifier 51 of the double nozzle-flapper type, and as also having a second-stage of the sliding spool type 52 including a lobed cylindrical valve spool 53 and a cylindrical valve sleeve member 54 surrounding the spool and movable relative thereto, both longitudinally along their axis 57 and rotatively about such axis. Spool 53 is slidable within the bore 55 of sleeve 54, which in turn is slidable within a cylindrical compartment 56 provided in a valve body 58.

Servovalve 31 includes a polarized torque motor 59 having electrical input coils 60, 60 and an armature 61. This armature 61 is fixed to a flapper 62 and the unitized armature/flapper member so provided is supported by a flexure tube 63 mounted on valve body 58 for frictionless pivotal movement about an axis 67 achieved by bending of this tube. A feedback spring wire 64 at one end is cantilever-mounted on flapper 62 and at its other end is constrained to move with spool 53. Thus, electrical input to the torque motor can apply a torque to the armature/flapper member, and bending of the feedback wire can also apply a torque to this member.

The first-stage hydraulic amplifier 51 includes left and right nozzles 65 and 66, respectively, on opposite sides of the flapper tip and fixed to body 58.

A left passage 68 having restrictor 69 therein conducts fluid from left supply passage $S_L$ to left nozzle 65, while a right passage 70 having restrictor 71 therein conducts fluid from right supply passage $S_R$ to right nozzle 66. The supply passages $S_L$ and $S_R$ are suitably manifolded together and lead to a supply port (not shown) in the valve body exterior. Return passage R which receives fluid discharged from the nozzles 65 and 66 leads to a return port (not shown) in the valve body exterior.

Movement of flapper 62 relative to nozzles 65 and 66 produces a corresponding dissymmetry of flows discharged by the nozzles and this differential flow is diverted to left and right end chambers 72 and 73, respectively, at opposite ends of spool 53. For this purpose, sleeve 54 has a left chamber port 74 constantly communicating with passage 68 by a branch passage 75, and the sleeve also has a right chamber port 76 constantly communicating with passage 70 by a branch passage 78.

Spool 53 is shown as having left outer and inner lobes 79 and 80, respectively, and right inner and outer lobes 81 and 82, respectively. Sleeve 54 is shown as having left and right supply ports 83 and 84, respectively, communicating with fluid supply passages $S_L$ and $S_R$, respectively, and an intermediate return port 85 communicating with fluid return passage R. Sleeve 54 is also shown as having left and right metering ports 86 and 88, respectively, constantly communicating with left and right actuating ports 89 and 90, respectively, in body 58. These actuating ports are provided in the exterior of the valve body in the actual servovalve. A conduit 91 constantly communicates left actuating port 89 with upper stroker port 47, and a conduit 92 constantly communicates right actuating port 90 with lower stroker port 48.

Figure 4:
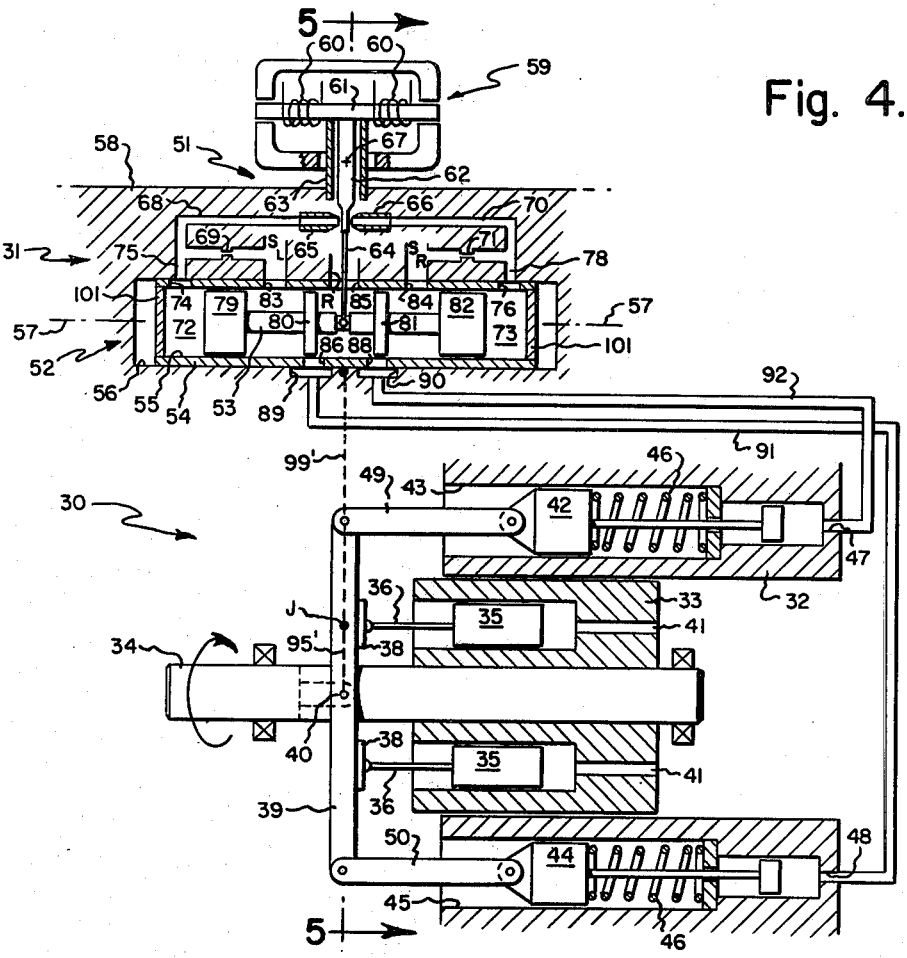
FIG. 4 is a schematic illustration of hydraulic apparatus comprising an electrohydraulic controller associated with a stroking mechanism for a variable-displacement pump, constructed in accordance with the principles of the present invention, the position of the pump being shown for no electrical input to the controller.

When both spool 53 and sleeve 54 are nulled on each other and centered relative to body 58, as shown in FIG. 4, the center two spool lobes 80 and 81 cover sleeve metering ports 86 and 88 toward supply $S_L$ and $S_R$, respectively, and open them toward return R.

Figure 8:
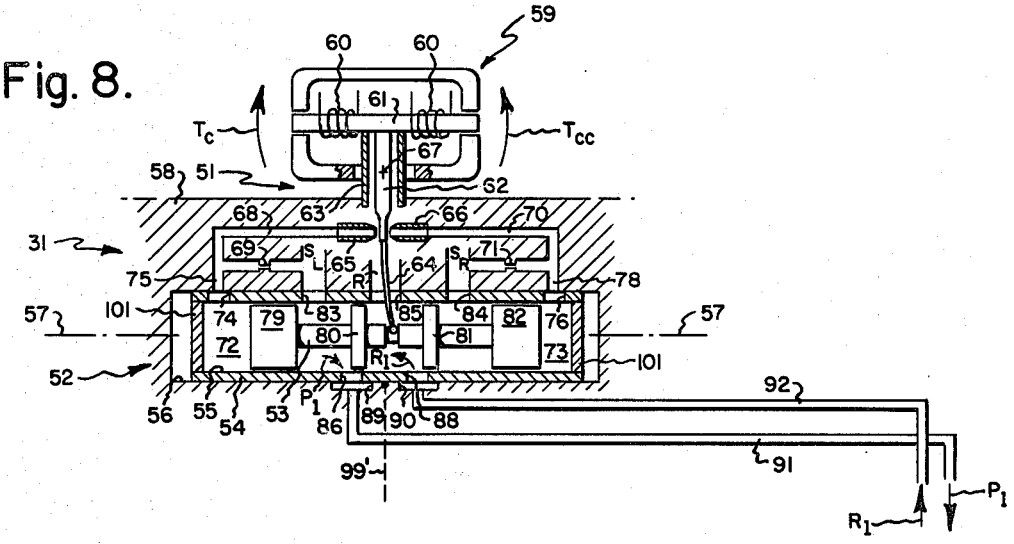
FIG. 8 is a schematic illustration of the electrohydraulic servocontroller shown in the upper portion of FIG. 4, and depicting in exaggerated fashion the displacement of the valve spool relative to the valve sleeve which takes place initially upon an electrical input to the controller to effect a fluid drive of the stroking mechanism before the swashplate is displaced from its position shown in FIG. 4.

A differential flow from the first-stage hydraulic amplifier to the spool end chambers 72 and 73 displaces spool 53 relative to sleeve 54, thereby communicating one of metering ports 86, 88 with corresponding supply $S_L$ or $S_R$ and the other with return R, as depicted in FIG. 8. This causes opposite flow in conduits 91, 92 to change the position of stroker pistons 42, 44, and thereby the angular position of swashplate 39 about its axis 40.

Figure 5:
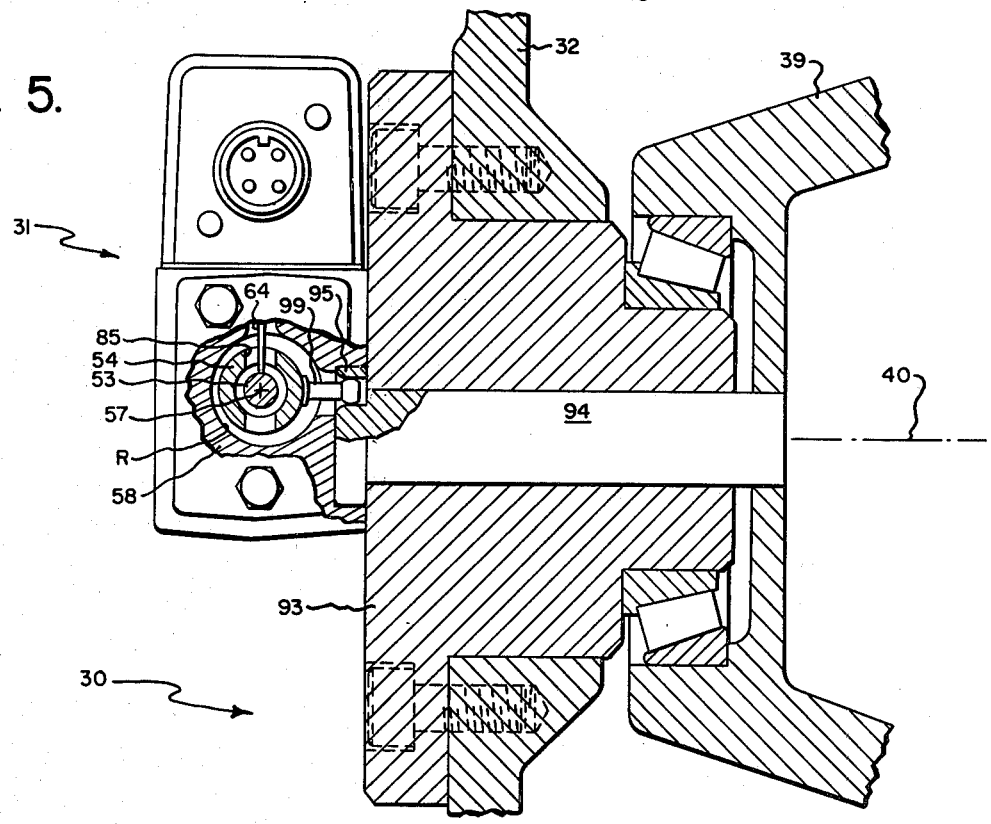
FIG. 5 is an enlarged fragmentary transverse vertical sectional view thereof, taken generally on line 5—5 of FIG. 4, and showing a trunnion for the swashplate illustrated fragmentarily and in section, and also showing the electrohydraulic controller mounted proximate such trunnion and illustrated principally in elevation, but with portions broken away to reveal the elements of the mechanical feedback mechanism operatively interposed between the swashplate and the output stage of the controller.
Figure 6:
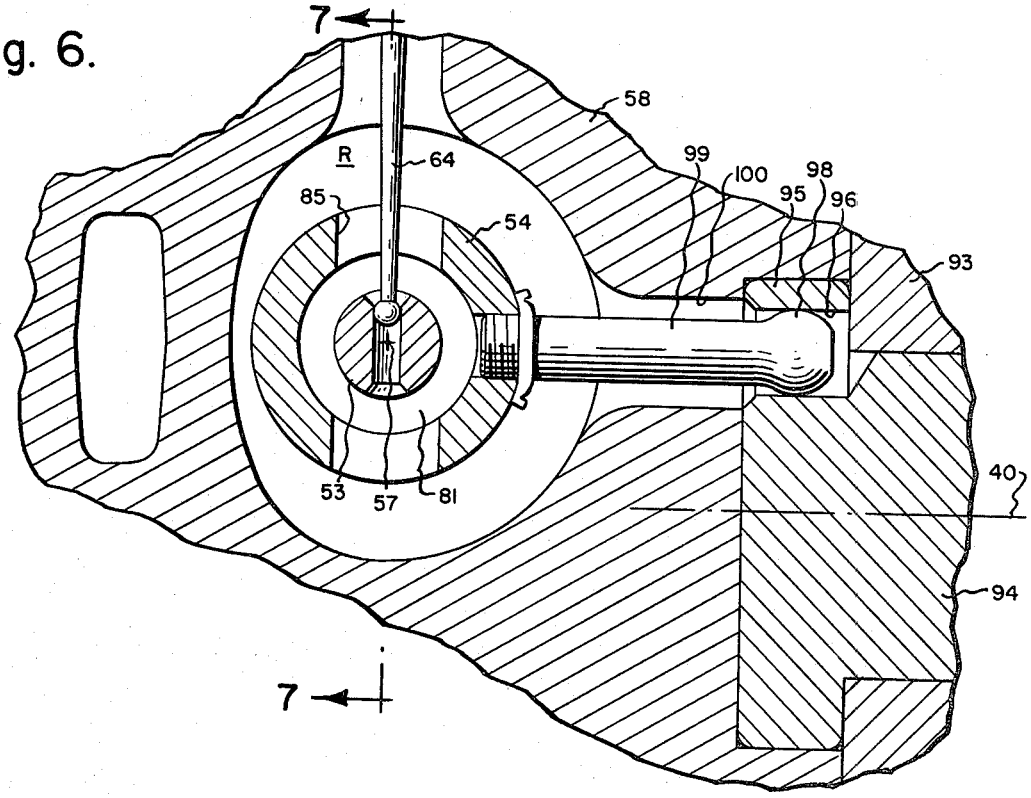
FIG. 6 is a still further enlarged fragmentary view of the portion of the controller output stage and feedback mechanism within the area shown broken away in FIG. 5.

Sleeve 54 carries an articulated feedback mechanism shown structurally in FIGS. 5 and 6 and schematically in FIGS. 4 and 7–9. Referring to FIG. 5, swashplate 39 is pivotally supported at one side of the pump housing 32 on a trunnion member 93 suitably secured to this housing. Servovalve 31 is suitably mounted on the outside of this trunnion member. A feedback shaft 94, coaxial with axis 40, rotatably penetrates member 93 and at its inner end is fast to swashplate 39 and at its outer end is provided with a lever 95. This lever has a cylindrical recess 96 (FIG. 6) which receives the spherically-surfaced ball head 98 of a rigid arm 99, which projects radially outwardly from sleeve 54 and is suitably fixed thereto. Valve body 58 is provided with a lateral opening 100 through which arm 99 extends to give access to lever 95. The engagement of the surface of ball head 98 on the cylindrical wall of recess 96 provides a rolling contact therebetween and an articulated joint between the feedback lever 95 and the feedback arm 99 to convert pivotal movement of this lever into longitudinal movement of sleeve 54 with slight rotation due to tipping of arm 99. This joint is schematically illustrated at J in FIGS. 4 and 9, wherein the feedback lever is represented by broken line 95' and the feedback arm by broken line 99'. Schematic feedback arm 99' is also partially illustrated in FIGS. 7 and 8.

Figure 7:
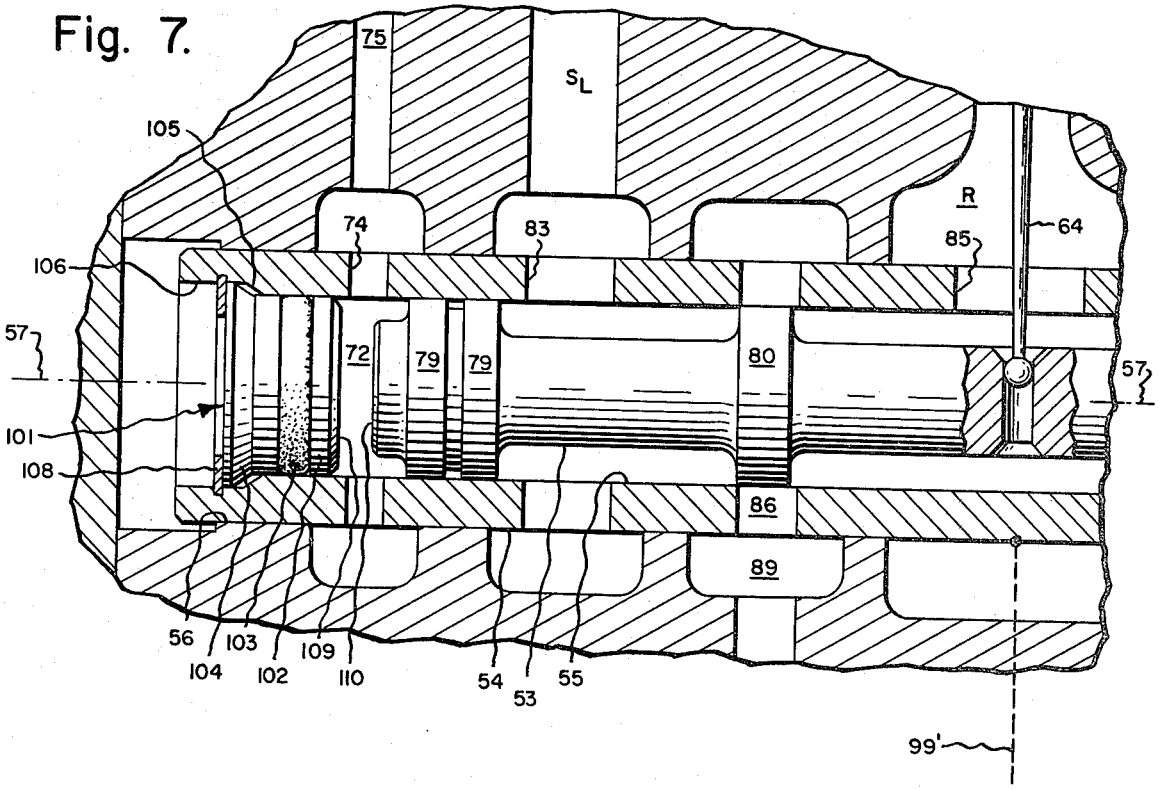
FIG. 7 is a fragmentary vertical longitudinal sectional view thereof taken generally on line 7—7 of FIG. 6, and showing an end portion of the relatively movable valve spool and surrounding sleeve member arranged in the servovalve body, corresponding to the left half of the output stage of the servovalve schematically illustrated in FIG. 4.

Referring to FIG. 4, the phase lead compensation means of the present invention includes means 101 closing off sleeve 54 at each end thereof outwardly of the corresponding end of valve spool 53, this sleeve being axially longer than this spool. Means 101, as shown in FIG. 7 at the left end of the valve, comprises a cylindrical plug 102 arranged in sleeve bore 55 and sealed to the wall thereof by an O-ring 103 arranged in an annular groove in this plug. An integral enlarged head 104 on the outer end of plug 102 is constrained by a seat 105 formed by a shoulder left by an enlarged end portion 106 of sleeve bore 55 and by a split retainer ring 108 partially arranged in an internal annular groove provided in the wall of bore portion 106. The inner end face of plug 102 provides a transverse closure for sleeve 54, defining an outer end wall 109 for spool end chamber 72, which end wall is spaced from and opposes the corresponding spool end face defining an inner end wall 110 for this chamber. The exposed portion of the internal surface of sleeve 54 forming bore 55 between walls 109 and 110, defines a surrounding wall for chamber 72. Chamber end walls 109 and 110 have the same transverse area.

The portions of body compartment 56 outwardly of the closures 101 at opposite ends of sleeve 54 are suitably vented, such as to drain (not shown), to allow free axial movement of this sleeve with its closed ends relative to valve body 58 and to accommodate any leakage from between the sleeve and body.

Referring to FIG. 7, it will be seen that if fluid is introduced into left chamber 72 from connected port 74 and passage 75, while sleeve 54 is regarded as remaining stationary relative to body 58, spool 53 will be driven rightwardly and displaced relative to this sleeve, thus increasing the axial spacing between chamber end walls 109 and 110 and increasing the volume of chamber 72. This condition, albeit unrealistically exaggerated, is depicted in FIG. 8. At this time, the lack of follow-up movement of the sleeve is more theoretical than real. The mechanical feedback link provided by lever 95', arm 99' and joint J will cause the axial position of sleeve 54 to move a distance along its axis 57 corresponding to the displacement of joint J in a direction parallel to such axis. Joint J moves in a circular path and it is only its component parallel to axis 57 that produces axial displacement of the sleeve. The circular movement of joint J is responsive to angular movement of swashplate 39 so that lever 99' moves through the same angle as the swashplate. In turn, angular displacement of the swashplate is responsive to displacement of stroker pistons 42, 44 controlled by flow through conduits 91, 92 connected to the valve actuating ports 89, 90.

In prior art servocontrollers, wherein the outer end walls 109 of spool end chambers 72, 73 remain stationary with respect to valve body 58, movement of sleeve 54 creates no hydraulic effect on the volume of fluid in the end chambers. The spool 53 is, therefore, displaced by differential flow from the first-stage hydraulic amplifier irrespective of displacement of the sleeve.

In the inventive concept, outer chamber walls 109 are carried by the sleeve 54, so that transverse displacement of the sleeve causes a differential change in the volume of fluid contained in the two spool end chambers 72, 73. This additional feedback effect tends to displace the valve spool 53 directly in response to displacement of the valve sleeve 54. For analytical purposes, it is convenient to consider this as a velocity relationship such that sleeve velocity can be related directly to differential flow between the spool end chambers.

Operation

In explaining the operation, it is assumed that the various parts initially are in the condition depicted in FIG. 4.

Let it now be assumed that there is an input to the servocontroller in the form of an electrical current i (FIG. 2) to the coils 60 of torque motor 59. The direction and magnitude of this current is such that it produces a torque $T_{TM}$ (FIG. 2) on the T-shaped armature/flapper member 61, 62 so as to pivot this member in a clockwise direction about pivotal axis 67, as viewed in FIG. 8, this direction being depicted by the arrow $T_c$. Such pivotal movement causes the tip of flapper 62 to move closer to the outlet of left nozzle 65, while this tip moves farther away from right nozzle 66. This diverts fluid flow into left spool end chamber 72, while further opening the connection of right spool end chamber 73 to drain R through right nozzle 66. The diversion of fluid flow into the left end chamber causes motion of the spool to the right, which is essentially unimpeded as the spool frictional forces, flow forces, and force necessary to deflect cantilever feedback spring 64, are each small with respect to the available drive force represented by differential pressure between end chambers 72, 73 acting on spool end area $A_V$ of FIG. 2. Consequently, it may be assumed that the magnitude of these frictional, flow and deflection forces are trivial throughout all normal operation. Such movement of the spool to the right displaces fluid from right end chamber 73 which combines with the fluid flow from supply $S_R$ through restrictor 71 and passes through passage 70 and nozzle 66 to return R. As this spool so moves it deflects the lower end of feedback wire spring 64 causing this spring to bend, thus producing a torque $T_W$(FIG. 2) on the armature/flapper, effective in a counterclockwise direction, as represented by the arrow $T_{cc}$ (FIG. 8). The spool will continue to displace rightwardly and the deflection of the feedback spring will increase until the torque exerted thereby on the armature/flapper produces a counterclockwise torque $T_W$ which counterbalances the electrically-induced clockwise torque $T_{TM}$ produced by the current input to the torque motor. When this occurs, the flapper tip will be returned to a position essentially centered between the nozzles, being offset only by a negligible amount sufficient to maintain a slight differential pressure between the spool end chambers as necessary to hold the spool in a displaced position. At this condition, flow is no longer diverted to either spool end chamber and flow $Q_1$ (FIG. 2) becomes zero. The hydraulic drive on the valve spool so ceasing, it stops and remains in a displaced position (FIG. 8) to the right of null or its centered position (FIG. 4). This displacement is represented by $X_V$ (FIG. 2). Thus, spool displacement $X_V$ is proportional to the magnitude of torque $T_{TM}$ (FIG. 2) on the armature/flapper member, which is proportional to the magnitude of current input i to the servovalve.

It should be recognized that an input current of larger or smaller magnitude will result in a correspondingly larger or smaller displacement of the spool, and that input currents of reversed polarity will result in corresponding spool displacement to the left of null (FIG. 4).

When spool 53 displaces rightwardly relative to valve sleeve 54, as depicted in FIG. 8, left inner lobe 80 uncovers left metering port 86 and right inner lobe 81 uncovers more of right metering port 88. This opening of left port 86 establishes communication between left supply pressure passage $S_L$, through supply port 83, and left actuating port 89 and associated conduit 91. The direction of pressurized fluid flow is represented by the arrows $P_1$ (FIG. 8). The enlarged communication between right metering port 88 and central return passage R allows fluid to flow from conduit 92 through right actuating port 90, through port 88 and return port 85 to drain. Such fluid flow to drain is represented by the arrows $R_1$ (FIG. 8). The flow through lines 91, 92 is represented by $Q_2$ (FIG. 2).

In FIG. 8, for illustrative purposes, it is assumed that no follow-up feedback movement $X_L$ (FIG. 2) of valve sleeve 54 has yet occurred so that the position of this sleeve relative to the valve body 58 is the same as depicted in FIG. 4. In other words, schematic feedback arm 99' is in the same position relative to the valve body in both FIGS. 4 and 8.

Figure 9:
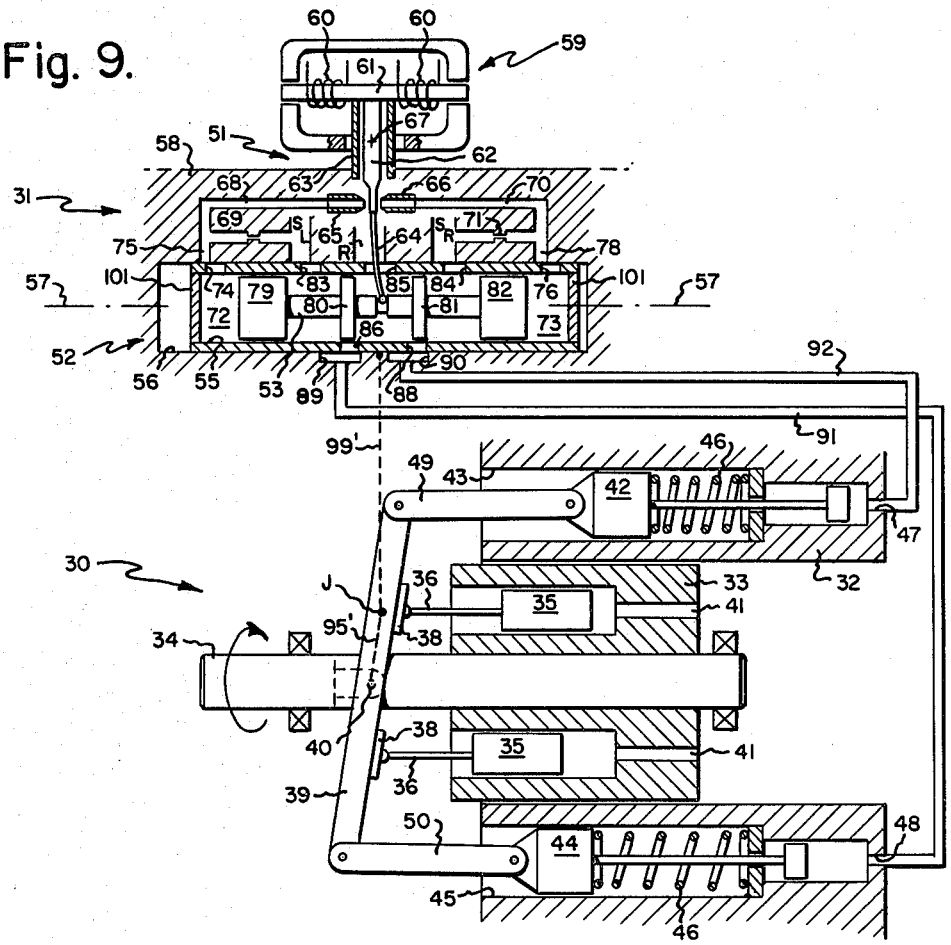
FIG. 9 is a schematic illustration of the apparatus shown in FIG. 4, but depicting the condition of the output stage of the controller after final displacement of the swashplate in response to the effect of an electrical input to the controller as depicted in FIG. 8.

Turning now to FIG. 9, the servovalve controller is in the same condition as depicted in FIG. 8, except that sleeve 54 has been returned to a nulled condition ($X_L=X_V$) on rightwardly-displaced valve spool 53. This comes about as a result of the change in angular position $\theta$ (FIG. 2) of swashplate 39 effected by fluid flow through conduits 91, 92, as will now be explained.

When flow $Q_2$ through ports 86, 88 and conduits 91, 92 in the direction of arrows $P_1$, $R_1$ is occurring, conduit 91 carries a higher pressure to pump housing port 48 than conduit 92 connected to pump housing port 47 which is connected to drain. This drives lower control piston 44 to the left pushing link 50 and the lower end of swashplate 39 leftwardly, while the upper end of this swashplate pushes link 49 and control piston 42 to the right. Such displacement of control pistons 42, 44 is represented by $X_p$ (FIG. 2). The result is that swashplate 39 has been pivoted in a clockwise direction about its axis 40, as viewed in FIG. 9, thus changing its angularity $\theta$ and establishing a length of stroke for pump pistons 35. This stroke is variable, and hence the output of the pump in ports 41, by so changing the angular position of the swashplate.

As swashplate 39 changes its position from that shown in FIG. 4 to that shown in FIG. 9, feedback lever 95' has also moved in a clockwise direction about pivotal axis 40 to shift joint J rightwardly. This joint is connected by rigid feedback arm 99' to valve sleeve 54. The effect is to move this valve sleeve rightwardly through a longitudinal displacement $X_L$ to a final position shown in FIG. 9 in which the metering ports 86, 88 are again disposed very close to the original condition with respect to the two inner lobes 80, 81 of the valve spool which already had a longitudinal displacement $X_V$. Only a negligibly small off-null condition is necessary to develop a differential pressure between the end areas of control pistons 42, 44 sufficient to maintain the pump swashplate in an angularly-displaced position. The effective size of the metering ports is determined by the displacement $X_V$ of the valve spool relative to the displacement of the sleeve $X_L$. It will be seen that such relation or the difference $X_{V-L}$ will initially correspond to $X_V$, as depicted in FIG. 8, and gradually reduce to essentially zero as $X_L$ approaches $X_V$ in valve due to sleeve follow-up. This means that flow $Q_2$ is initially high and tapers off to zero. During the course of follow-up movement of valve sleeve 54 relative to the displaced valve spool 53, this sleeve both shifts longitudinally along axis 57, represented by $X_L$, and rotates about this axis due to tipping of arm 99. In reality, such longitudinal movement is small and such rotative movement is even more minute.

The articulated feedback mechanical connection 95', J, 99' between swashplate 39 and valve sleeve 54 converts the angular displacement of the swashplate about axis 40 into a longitudinal displacement of the sleeve along axis 57. Until this sleeve nulls on the already displaced valve spool, flow will continue through conduits 91, 92 to drive stroker pistons 42, 44. When these pistons stop moving, the swashplate will be left in a new angular position, which will correspond to the new longitudinal position of the valve sleeve, now nulled on the valve spool. Thus, there is produced a one to one follow-up of this sleeve relative to the swashplate.

A change in current input to the torque motor will produce a proportionate change in valve spool position, in turn producing a change in position of the stroker pistons thereby changing the angularity of the swashplate about its pivotal axis. The feedback lever moves through the same angle as the swashplate and by its articulated connection with the feedback arm slaves the metering port sleeve on the valve spool.

While the operation of the electrohydraulic controller has been described for a current input having a direction operative to effect an initial clockwise pivotal motion of the armature/flapper member and a consequent rightward displacement of the valve spool, it will be appreciated that the same sort of action takes place in opposite directions if the current direction is reversed or reduced so that conduit 92 becomes the high pressure line and conduit 91 becomes the low pressure line leading to drain.

The proportionality of valve spool position to input current, and swashplate position to valve spool position just described, exists for steady-state conditions following the application of a fixed value of input current. The dynamic response of swashplate position with respect to input current is expressed by the amplitude ratio of the frequency response given in FIG. 3, the inventive distinction being the addition of a phase lead compensation loop represented physically by the containment of the spool end chamber outer walls by the movable sleeve 54. Without this phase lead effect, the dynamic response of the valve spool feedback loop, represented by the transfer function of $X_V/i$ illustrated as $FR_1$ of FIG. 3, is cascaded with the dynamic response of the swashplate positioning loop, represented by the transfer function of $\theta/X_v$, illustrated as $FR_2$ of FIG. 3, to determine the overall dynamic response of $\theta/i$. The addition of phase lead compensation is accomplished by injecting into the valve spool control loop a condition representing the desired or anticipated results of the swashplate positioning loop. This condition can be envisioned as a momentary bootstrapping, or temporarily regenerative effect, which speeds-up the response of the swashplate positioning loop.

Following a change in displacement of the valve spool in response to a change in electrical input current, the swashplate commences to move, and this movement causes the sleeve to displace towards a follow-up final position. While the sleeve is moving, as to the right for the example illustrated in FIGS. 8 and 9, the closure of end chamber 72 by the sleeve will temporarily displace the valve spool 53 still further to the right. This momentary excess of spool displacement over and above the displacement that results from electrical input will cause a transient increase in the fluid flow $Q_2$ to the control pistons above the magnitude of flow that would otherwise exist. This increased flow to the control pistons result in a reduction of dynamic lag between the sleeve and spool, that is, a reduction in the time necessary for the sleeve to move to a nulled position on the displaced spool. In other words, control pistons 42 and 44 respond faster due to the maintenance of a high degree of fluid flow thereto. In the finally displaced condition of the swashplate and sleeve, as illustrated in FIG. 9, the influence of sleeve movement on spool position will have dissipated, and the ultimate proportionality of swashplate position to electrical input will be unaffected. The selection of design parameters for the spool, the sleeve and for other elements of the servomechanism can be accomplished in a manner to obtain satisfactory stability and improved dynamic response in a manner well understood by those skilled in the art of electrohydraulic servocontrol.

From the foregoing, it will be seen that the embodiment illustrated and described herein accomplishes the various stated objectives of the invention. Since variations and modifications of the structure will readily occur to those skilled in the art within the spirit of the inventive concept, the scope of the invention is to be measured by the appended claims.

What is claimed is:

1. Hydraulic apparatus including a fluid-operated positioning mechanism for adjusting the position of a movable load, including a controller having an output stage including a movable spool member and a movable sleeve member arranged such that the relative positions of said members controls the flow of hydraulic fluid with respect to said positioning mechanism, and including feedback means interposed between said load and one of said members and operative to produce movement of said one member in response to movement of said load, wherein the improvement comprises:

positive feedback means arranged to act between said members to reduce the dynamic lag of said one member in moving to a stable nulled position relative to said other member after said other member has been moved to a displaced position, thereby to increase the frequency response to said apparatus.

2. Hydraulic apparatus as set forth in claim 1 wherein said load is mounted for pivotal movement.

3. Hydraulic apparatus as set forth in claim 2 and further comprising a hydraulic device, and wherein said load is a swashplate, the angled position of which controls the hydraulic performance of said device.

4. Hydraulic apparatus as set forth in claim 1 wherein said positive feedback means includes:

closure means mounted on one of said members and providing a fluid drive chamber for the other of said members.

5. Hydraulic apparatus as set forth in claim 4 wherein the volume of said drive chamber may vary as said members move relative to one another.

6. Hydraulic apparatus as set forth in claim 1 wherein said one member is a sleeve surrounding said spool and extending axially therebeyond, and further comprising:

closure means mounted on said sleeve and defining a fluid drive chamber at each end of said spool.

7. Hydraulic apparatus as set forth in claim 6 wherein said closure means includes a transverse wall mounted on each marginal end portion of said sleeve, each of said walls defining with a portion of said sleeve said drive chamber effective on an end face of said spool.

8. Hydraulic apparatus as set forth in claim 4 wherein said controller includes a hydraulic amplifier, and wherein said hydraulic amplifier communicates with said drive chamber.

9. Hydraulic apparatus as set forth in claim 7 wherein said controller includes a hydraulic amplifier, and wherein said hydraulic amplifier communicates with said drive chambers.

10. Hydraulic apparatus, comprising:

a torque motor;

a first-stage hydraulic amplifier controlled by said torque motor;

a second-stage movable spool member;

a second-stage movable sleeve member;

one of said members being movable in response to the fluid output of said amplifier;

first feedback means operatively interposed between said one member and said amplifier to displace said one member a distance proportional to a command signal supplied to said torque motor;

a load movable in response to the flow of fluid from said second-stage as established by the relative positions of said members;

second feedback means operatively interposed between said load and the other of said members; and positive feedback means operatively arranged to increase the dynamic response of said apparatus, said positive feedback means including closure means movable with said other member and operatively arranged to influence the fluid drive on said one member.

* * * * *